United States Patent [19]

Sunada

[11] Patent Number: 4,563,932

[45] Date of Patent: Jan. 14, 1986

[54] WAVEFORM DATA READ SIGNAL GENERATING APPARATUS

[75] Inventor: Takuya Sunada, Tokyo, Japan

[73] Assignee: Casio Computer Co., Ltd., Tokyo, Japan

[21] Appl. No.: 593,636

[22] Filed: Mar. 26, 1984

[30] Foreign Application Priority Data

Apr. 4, 1983 [JP] Japan ..... 58-57980
Apr. 4, 1983 [JP] Japan ..... 58-57981

[51] Int. Cl.[4] ..... G10H 1/06; G10H 7/00
[52] U.S. Cl. ..... 84/1.22; 84/1.01
[58] Field of Search ..... 84/1.01, 1.03, 1.22, 84/1.23

[56] References Cited

U.S. PATENT DOCUMENTS 4,351,212 9/1982 Okamoto et al. .
4,466,325 8/1984 Takaji ..... 84/1.22

*Primary Examiner*—S. J. Witkowski
*Attorney, Agent, or Firm*—Frishauf, Holtz, Goodman & Woodward

[57] ABSTRACT

A note ROM is addressed in response to a note code signal generated from a note code generator, and basic data is read out from the note ROM. The basic data is shifted by one higher bit and is thus doubled, and the shifted data is supplied to the A terminals of a full-adder. The basic data read out from the note ROM is supplied to the B terminals of the full-adder. The full-adder generates integer multiple data which has a value three times that of the basic data. This integer multiple data is decremented by one every time a clock is generated. When the integer multiple data becomes zero, a one-shot waveform data read clock signal is generated through an inverter.

26 Claims, 7 Drawing Figures

| TONE NAME | D3 | D2 | D1 | D0 |
|---|---|---|---|---|
| C | 0 | 0 | 0 | 0 |
| C# | 0 | 0 | 0 | 1 |
| D | 0 | 0 | 1 | 0 |
| D# | 0 | 0 | 1 | 1 |
| E | 0 | 1 | 0 | 0 |
| F | 0 | 1 | 0 | 1 |
| F# | 0 | 1 | 1 | 0 |
| G | 1 | 0 | 0 | 0 |
| G# | 1 | 0 | 0 | 1 |
| A | 1 | 0 | 1 | 0 |
| A# | 1 | 0 | 1 | 1 |
| B | 1 | 1 | 0 | 0 |

FIG. 4

| TONE NAME | D3 | D2 | D1 | D0 |
|---|---|---|---|---|
| C | 0 | 0 | 0 | 0 |
| G | 0 | 0 | 1 | 1 |
| D | 0 | 0 | 0 | 1 |
| A | 0 | 1 | 0 | 0 |
| E | 0 | 1 | 1 | 1 |
| B | 0 | 1 | 0 | 1 |
| D# | 1 | 0 | 0 | 0 |
| A# | 1 | 0 | 1 | 1 |
| F | 1 | 0 | 0 | 1 |
| F# | 1 | 1 | 0 | 0 |
| C# | 1 | 1 | 1 | 1 |
| G# | 1 | 1 | 0 | 1 |

FIG. 6

| TONE NAME | D3 | D2 | D1 | D0 |
|---|---|---|---|---|
| C | 1 | 1 | 0 | 0 |
| G | 1 | 1 | 1 | 1 |
| D | 1 | 1 | 0 | 1 |
| A | 0 | 0 | 0 | 0 |
| E | 0 | 0 | 1 | 1 |
| B | 0 | 0 | 0 | 1 |
| D# | 1 | 0 | 0 | 0 |
| A# | 1 | 0 | 1 | 1 |
| F | 1 | 0 | 0 | 1 |
| F# | 0 | 1 | 0 | 0 |
| C# | 0 | 1 | 1 | 1 |
| G# | 0 | 1 | 0 | 1 |

FIG. 7

| | | |
|---|---|---|
| C 63 | G 42 | D 56 |
| D# 53 | A# 35 | F 47 |
| F# 44 | C# 59 | G# 39 |
| A 37 | E 49 | B 33 |

WAVEFORM DATA READ SIGNAL GENERATING APPARATUS

BACKGROUND OF THE INVENTION

The present invention relates to an apparatus for generating a waveform data read signal to be supplied to a memory for storing waveform data of a musical tone.

Recently, main circuits of electronic musical instruments have been constituted by digital circuits. When a tone signal is to be generated in accordance with digital signal processing, one-period waveform data of a tone produced by a natural musical instrument is prestored in a memory, and the stored data is read out in response to a waveform data read clock which has a frequency corresponding to the frequency of the tone to be generated. In this conventional waveform data read clock generating circuit, a generator is arranged to generate a 4-bit note code signal in accordance with a depressed key of the keyboard. The generated note code signal is supplied as an address signal to a ROM so as to determine a pitch of a given note. The ROM stores pitch data each having a predetermined value corresponding to a frequency of the given note. The pitch data read out from the ROM is supplied to a subtractor which comprises a full-adder. The subtractor performs subtraction for a number of times corresponding to the frequency. When the outputs from the full-adder become all "0", the waveform signal read clock generating circuit generates a signal of logic "1". This "1" signal is supplied as the waveform signal read clock to a waveform memory, so that one sampled peak value date is read out. Therefore, the higher the pitch of the note corresponding to a depressed key, the shorter the period of time taken for setting the outputs from the full-adder to be all "0". The duration for reading out the peak value data from the waveform memory is thus shortened. Thus, the resultant note has a high pitch.

In general, a one-octave scale consists of 12 notes. Four-bit data must be used to generate 12 different note codes. In this sense, the ROM for storing pitch data must have 12 memory locations, and 6-bit pitch data must be stored in each memory location. Therefore, this ROM must have a relatively large memory capacity, resulting in high cost of an electronic musical instrument.

SUMMARY OF THE INVENTION

It is an object of the present invention to provide a relatively simple, low-cost signal generating apparatus for generating a waveform data read signal to be supplied to a memory for storing note waveform data.

In order to achieve the above object of the present invention, there is provided a waveform data read signal generating apparatus comprising: means for generating a plurality of note code signals in accordance with musical performance; means for generating basic data which has a basic value in common with a plurality of notes of frequencies capable of being represented at a prescribed simple integer ratio; means for multiplying the basic data by an integer in accordance with the respective one of said note code signals; and calculating means for generating a waveform data read signal in accordance with the multiplied basic data.

BRIEF DESCRIPTION OF THE DRAWING

FIG. 4 is an output note code table of a note code generator of the apparatus shown in FIG. 3;

FIG. 6 is an output note code table of a note code generator of the apparatus shown in FIG. 5; and FIG. 7 is a table showing the relationship between notes and integer multiple data.

DETAILED DESCRIPTION OF THE PREFERRED EMBODIMENTS

In a first embodiment, common basic data is read out for two notes or tone names (e.g., C and G) which constitute a perfect fifth and which have a frequency ratio of 2:3. The common basic data is multiplied by the integer three for the note C, and by the integer two for the note G, to shape waveform data read clocks which are supplied to a waveform memory. Sampled peak value data corresponding to these waveform data read clocks are read out from the waveform memory, thereby generating the two notes C and G having the frequency ratio of 2:3.

Figures 1, 2:
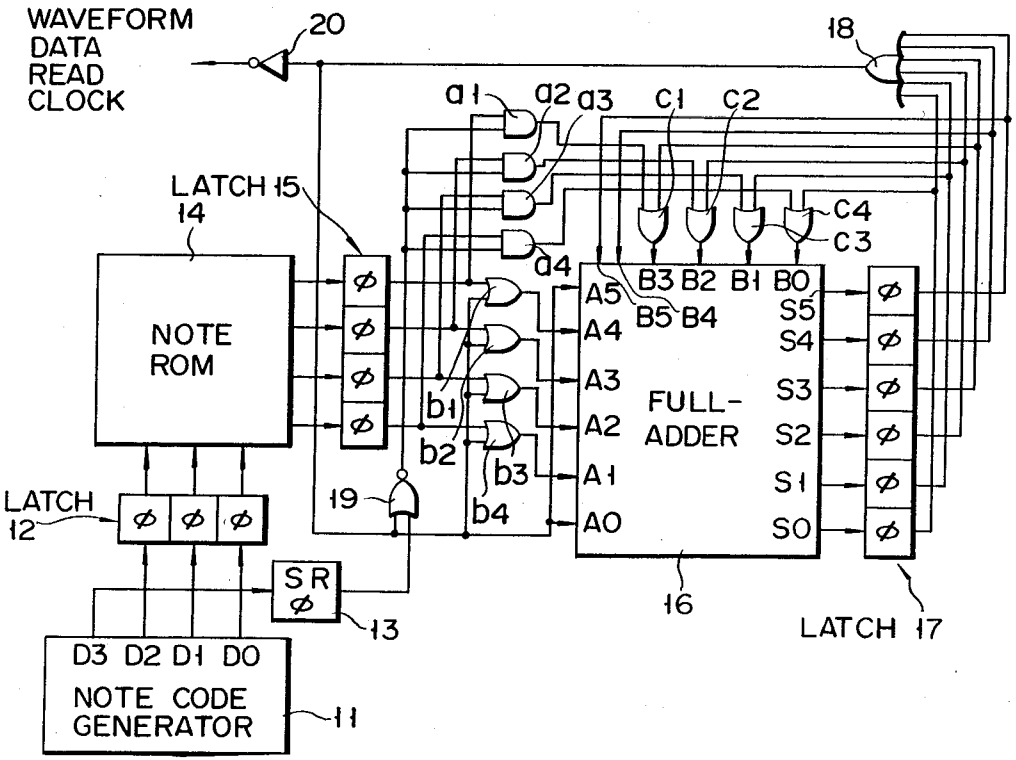
FIG. 1 is a block diagram of a waveform data read signal generating apparatus according to an embodiment of the present invention.
FIG. 2 is an output note code table of a note code generator of the apparatus shown in FIG. 1.

The first embodiment will be described in detail with reference to FIG. 1. Referring to FIG. 1, a note code generator 11 generates 4-bit note code signals, shown in FIG. 2, respectively corresponding to tone names, in accordance with musical performance at a keyboard. A note code signal generated by the note code generator 11 is supplied to a 3-bit latch 12 and a 2-bit shift register 13. The latch 12 receives the lower note codes D0 to D2 of the note codes D0 to D3 when the latch generates respective clock pulses $\phi$. Similarly, the shift register 13 receives the note code D3 when it generates a clock pulse $\phi$. Assume the note codes of the tone names C and G constitute a perfect fifth. The logic level of the MSB or highest code D3 is set to be "0" for the tone name C, and "1" for the tone name G which has a higher pitch than the note C. Other codes D0 to D2 are common for the tone names C and G.

The values of the codes D0 to D2 latched by the latch 12 are supplied as an address signal to a note ROM 14. Basic data m is read out from the note ROM 14 and is latched by a 4-bit latch 15 when the latch 15 generates the clock pulses $\phi$. Four-bit basic data corresponding to the data m and computed by the relation $1/fx=3\times 8(m+1)T\phi$ are stored in the note ROM 14, where fx is the frequency of the note to be generated, $T\phi$ is the period of the clock pulse $\phi$, and 8 is a factor for dividing a one-period waveform into eight wave portions and sampling the resultant eight wave portions.

The 4-bit basic data m is latched by the latch 15, and bit data of the 4-bit data m are respectively supplied to the A1 to A4 terminals of a 6-bit full-adder 16 through OR gates b1, b2, b3 and b4, respectively, and to the B3 to B0 terminals of the full-adder 16 through AND gates a1, a2, a3 and a4 and OR gates c1, c2, c3 and c4, respectively. The full-adder 16 receives 6-bit data at the A0 to A5 terminals and at the B0 to B5 terminals, and adds these 6-bit data. The 6-bit data of the resultant sum data respectively appear at the S0 to S5 terminals of the full-adder 16.

The integer multiple data generated from the S terminals of the full-adder 16 are latched by a latch 17 when the latch 17 generates the clock pulses $\phi$. The four lower bit data of the integer multiple data from the latch 17 are respectively supplied to the B0 to B3 terminals of the full-adder 16 through the OR gates C4 to C1. The two upper bit data of the integer multiple data from the latch 17 are directly supplied to the B4 and B5 terminals of the full-adder 16. At the same time, the 6-bit integer multiple data from the latch 17 is supplied to an OR gate 18. An output from the OR gate 18 is supplied to the A0 and A5 terminals of the full-adder 16, directly, and to the A1 to A4 terminals through the OR gates b4 to b1. The output from the OR gate 18 is also supplied to one input terminal of a NOR gate 19.

The output from the shift register 13 is supplied to the other input terminal of the NOR gate 19. An output from the NOR gate 19 is supplied as a gate control signal to AND gates a1 to a4. For this reason, the NOR gate 19 causes the AND gates a1 to a4 to open only when the note code D3 is set to be logic "0". In this case, the basic data m is supplied to the B terminals of the full-adder 16. However, when the code D3 is set at logic "1", the AND gates a1 to a4 remain closed so that no data is supplied to the B terminals of the full-adder 16.

An inverter 20 is connected to an output terminal of the OR gate 18. A waveform data read clock of logic "1" is generated from the inverter 20 every time the output from the OR gate 18 is set to be logic "0", and is supplied as an address signal to a waveform memory (not shown).

The operation of the waveform data read signal generating apparatus having the arrangement described above will now be described.

Note codes vary in accordance with tone names, as shown in FIG. 2, and constitute a 4-bit code signal. This code signal is generated by the note code generator 11. Assume that the note C is specified at the keyboard. Binary data "000" of the lower codes D0 to D2 is latched by the latch 12 when the latch 12 generates the clock pulses $\phi$. At the same time, binary data "0" of the highest code (MSB) D3 is supplied to the shift register 13 when the shift register generates the clock pulse $\phi$. The basic data m corresponding to input data "000" is read out from the note ROM 14 and is latched by the latch 15 when the latch 15 generates the clock pulses $\phi$. The output clock pulses are supplied to the AND gates a1 to a4 and the OR gates b1 to b4, respectively. In this case, the outputs appearing at the S terminals of the full-adder 16 are set to be all "0", and the data latched by the latch 17 are set to be all "0", that the output from the OR gate 18 is set to be all "0". Therefore, data of "0" are applied to the A0 and A5 terminals of the full-adder 16, and the basic data is applied without modification to the A1 to A4 terminals of the full-adder 16 through the OR gates b4 to b1. At the same time, the data "0" of the note code D3 is supplied from the 2-bit shift register 13 to the NOR gate 19. In this case, the output from the OR gate 18 is set to be logic "0", so that the output from the NOR gate 19 is set to be logic "1". The AND gates a1 to a4 are then opened, and the bit data of the basic data signal are gated through the AND gates a1 to a4 and are supplied to the OR gates c1 to c4. The bit values of the latch 17 are set to be all "0", so that the bit data of the basic data m are supplied to the B0 to B3 terminals of the full-adder 16 through the OR gates c4 to c1, respectively. Meanwhile, data of "0" are supplied from the latch 17 directly, to the B4 and B5 terminals of the full-adder 16.

Integer multiple data is then obtained by shifting the basic data by one upper bit so that the shifted data is equal to twice the basic data, and is supplied to the A terminals of the full-adder 16. The basic data m is supplied without modification to the B terminals of the full-adder 16. The integer multiple data and the basic data m are then added by the full-adder 16, so that the resultant integer multiple data corresponding to three times the basic data m appears at the S terminals of the full-adder 16. Therefore, in order to generate the note C, the note ROM 14 can store data as the basic data m which has a value one-third that of the resultant integer multiple data, and the resultant integer multiple data can be obtained at the S terminals of the full-adder 16.

The bit data of the 6-bit integer multiple data appearing at the S terminals of the full-adder 16 are latched by the latch 17 when the latch 17 generates the next clock pulses $\phi$. At least one bit of this integer multiple data is always set to be logic "1", so that an output from the OR gate 18 is set to be logic "1". Data of logic "1" are respectively supplied to the A0 to A5 terminals of the full-adder 16. At the same time, the output from the NOR gate 19 is set to be logic "0" irrespective of the output value of the shift register 13. The AND gates a1 to a4 are closed, so that the basic data m is not gated to the B terminals of the full-adder 16 through the AND gates a1 to a4. Instead, the outputs from the AND gates a1 to a4 are set to be all "0", and the respective bit data of the integer multiple data from the latch 17 are supplied to the B0 to B5 terminals of the full-adder 16.

The full-adder 16 performs the following calculation: (integer multiple data)+111111, that is, (integer multiple data)−1. The resultant data appears at the S terminals of the full-adder 16 and is latched by the latch 17 when the next clock pulse $\phi$ is generated therefrom. Every time the clock pulses $\phi$ are generated, the calculation (integer multiple data)−1 is performed. This calculation is then repeated (m+1) times. When the calculation result becomes zero, the output from the OR gate 18 is set to be logic "0". As a result, the waveform data read clock is one-shot generated through the inverter 20. In this manner, every time the output from the OR gate 18 is set to be logic "0", the basic data m is supplied to the A and B terminals of the full-adder 16, and the same operation as described above is repeated.

The waveform data read clock is supplied to the waveform memory and the next sampled peak value data is read out therefrom. After eight read clocks are consecutively generated, a one-period waveform is obtained. When data corresponding to another one-period waveform are read out, a tone corresponding to the note C is generated. For this reason, when the value of the integer multiple data latched by the latch 17 is larger, the clock interval between the two adjacent read clocks is increased. Therefore, the frequency of the tone generated is decreased, so that a lower tone is generated.

Assume that a key is depressed corresponding to the note G which has a period two-thirds that of the note C, and which together with the note C constitutes a perfect fifth. The lower three bits or codes D0 to D2 of the note code signal of the note G are given to be "000" in the same manner as for the note C. The MSB or the highest code D3 of the signal is set to be "1" unlike the MSB of the note code signal of the note C. The basic data m read out from the note ROM 14 and latched by the latch 15 is the same as that for the note C. However, data of logic "1" is supplied to the NOR gate 19 through the shift register 13, so that an output from the NOR gate 19 is set to be logic "0". The AND gates a1 to a4 will not be opened, and the output terminals thereof are set to be all "0". The output values of the latch 17 are set to be all "0". Data of "0" are supplied to all the B terminals of the full-adder 16, while the basic data m is supplied to the A1 to A4 terminals of the full-adder 16. As a result, integer multiple data which has a value twice that of the basic data m appears at the S terminals of the full-adder 16 and is then latched by the latch 17. The subsequent operation is the same as in generation of the note C. Therefore, a note G having a frequency 3/2 times that of the note C is generated.

In this manner, the notes C# and G#, D and A, D# and A#, and E and B, which pairs respectively constitute perfect fifths, can be generated such that the lower codes D2 to D0 have different combinations of values of the corresponding basic data m.

In the notes C and G which constitute a perfect fifth, the data read out from the note ROM 14 is common for these notes. This basic data is multiplied by three or two, respectively. In this case, the data stored in the note ROM 14 can be the common basic data m. This is sufficient to any other perfect fifth pair such as C# and G#, and D and A. Therefore, only seven 3-bit basic data m are sufficient to generate 12 notes of one octave. In addition to this advantage, the data value of each basic data stored in the note ROM 14 can be only one-third that of the data to be actually used for generating notes. For example, when the data to be actually used comprises 6-bit data, the basic data can comprise 4-bit data. As a result, the input data are small in value, and the storage capacity of the note ROM 14 can be decreased.

The basic data m stored in the note ROM 14 are prepared for one octave. In order to generate notes of other octaves, the waveform data read clock can be frequency-divided into halves or quarters.

Figure 3:
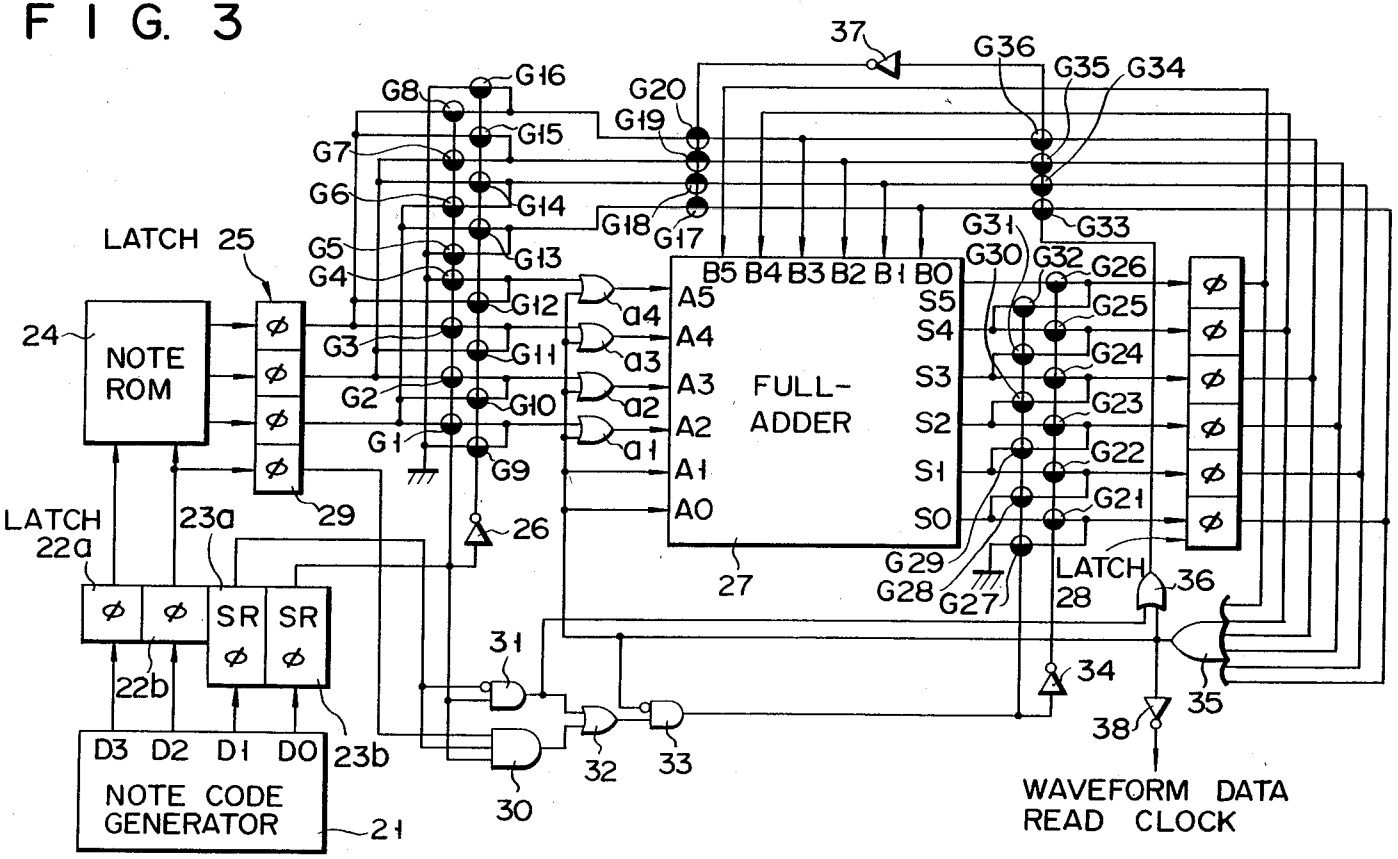
FIG. 3 is a block diagram of a waveform data read signal generating apparatus according to another embodiment of the present invention.

FIG. 3 shows a waveform data read clock generating circuit according to a second embodiment of the present invention. Common basic data is read out and is multiplied by the integers 9, 6 and 4 to generate three tone names or notes (having a given frequency ratio of 4:6:9) which constitute a sequence of perfect fifths in the order named.

Referring to FIG. 3, there is provided a note code generator 21. The note code generator 21 generates 4-bit note code signals shown in FIG. 4 in accordance with musical performance at the keyboard. The upper two bit codes D3 and D2 of each 4-bit note code signal are latched by latches **22*a* and 22*b* when the latches 22*a* and 22*b* generate clock signals $\phi$, respectively. The lower two bit codes D1 and D0 of each 4-bit note code signal are respectively supplied to shift registers 23*a* and 23*b* which constitute a 2-bit shift register circuit when the shift registers 23*a* and 23*b* generate the clock pulses $\phi$, respectively. Unlike the note code signal of the first embodiment shown in FIG. 2**, the upper bit codes D3 and D2 of the notes C, G and D are all set to be "00", and the lower bit codes D1 and D0 thereof are respectively set to be "00", "11" and "01". This relationship between the notes C, G and D can be applied to any other set of notes (e.g., A, E and B) which constitute a perfect fifth sequence, except that the upper bit codes D3 and D2 change to be "01" which is common to these notes. In other words, the lower bit codes D1 and D0 of the set of notes A, E and B are set to be "00", "11" and "01", respectively.

The code values of the codes D3 and D2 respectively latched by the latches **22*a* and 22*b* are supplied as address signals to a note ROM 24, so that 3-bit basic data l is read out from the note ROM 24. This 3-bit basic data is latched by a 3-bit latch 25 when the latch 25 generates the clock pulses $\phi$. The note ROM 24** stores 3-bit data corresponding to l which is calculated by the relation $1/fx=9\times8(l+1)T$, where fx is the frequency of the note to be generated, $T\phi$ is the period of the clock pulse $\phi$, and 8 is a factor for dividing a one-period waveform into eight wave portions and sampling the resultant eight wave portions.

Meanwhile, an output from the shift register **23*b* is supplied to transfer gates G1 to G8 so as to control the on/off operation of these gates. The output from the shift register 23*b* is also supplied to transfer gates G9 to G16 through an inverter 26 so as to control the on/off operation of these gates. Either the set of transfer gates G1 to G8 or the set G9 to G16 is opened in accordance with the logic level of the LSB code D0 of the code signal. The transfer gates G1 to G16 are divided into groups of transfer gates G1 to G4, G5 to G8, G9 to G12, and G13 to G16. The 3-bit basic data l and the ground level "0" are supplied to the respective groups, such that the ground level "0" is supplied to the transfer gate G4 of the group of gates G1 to G4 and the transfer gate G16 of the group of gates G13 to G16, and the three bit data of the basic data from the latch 25 are supplied to the remaining gates G1 to G3 and G13 to G15, and such that the ground level "0" is supplied to the transfer gate G5 of the group of gates G5 to G8 and the transfer gate G9 of the group of gates G9 to G12, and the three bit data of the basic data from the latch 25** are supplied to the remaining gates G6 to G8 and G10 to G12.

Outputs from the transfer gates G1 to G4 and G9 to G12 are supplied to the A2 to A5 terminals of a full-adder 27 through OR gates a1 to a4, respectively. Outputs from the transfer gates G5 to G8 and G13 to G16 are supplied to the B0 to B3 terminals of the full-adder 27 through other transfer gates G17 to G20, respectively.

The full-adder 27 adds the 6-bit data supplied to the A0 to A5 terminals and the B0 to B5 terminals, and generates the resultant sum data from the S0 to S5 terminals thereof.

The integer multiple data appearing from the S terminals of the full-adder 27 are latched by a 6-bit latch 28 through transfer gates G21 to G26 or G27 to G32 when the latch 28 generates clock pulses $\phi$. When the transfer gates G21 to G26 among the transfer gates G21 to G32 are opened, the integer multiple data is latched by the latch 28 without modification. However, when the transfer gates G27 to G32 are opened, the integer multiple data appearing at the S0 to S5 terminals of the full-adder 27 is shifted by one upper bit, and the shifted data is then latched by the latch 28. In this case, the integer multiple data is further multiplied by two, and the ground level "0" is latched in the LSB of the latch 28 through the transfer gate G27.

On the other hand, the code value of the code D2 latched by the latch **22*b* is also latched by a latch 29. An output from the latch 29** and outputs from the shift registers 23*a* and 23*b* are supplied to a 3-input AND gate 30. An inverted output of the output from the shift register 23*a* and the output from the shift register 23*b* are supplied to a 2-input AND gate 31. Outputs from the AND gates 30 and 31 are supplied to an OR gate 32. An output from the OR gate 32 is supplied to the transfer gates G27 to G32 through an AND gate 33. The output from the AND gate 33 is also supplied to the transfer gates G21 to G26 through an inverter 34, so that either the set of transfer gates G21 to G26 or the set G27 to G32 is opened.

The integer multiple data latched by the latch 28 is supplied such that the four lower bit data thereof are respectively supplied to the B0 to B3 terminals of the full-adder 27 through transfer gates G33 to G36, and the two upper bit data thereof are respectively supplied to the B4 and B5 terminals of the full-adder 27. The 6-bit integer multiple data output from the latch 28 is supplied to an OR gate 35. An output from the OR gate 35 is supplied to the A0 and A1 terminals of the full-adder 27. This output from the OR gate 35 is also supplied to the A2 to A5 terminals of the full-adder 27 through the OR gates a1 to a4, and to an OR gate 36.

The OR gate 36 also receives the output from the AND gate 31. An output from the OR gate 36 is supplied to the transfer gates G33 to G36, and thence to the transfer gates G17 to G20 through an inverter 37. Therefore, either the set of transfer gates G17 to G20 or the set G33 to G36 is opened.

The operation of the waveform data read clock generating apparatus according to the second embodiment of the present invention will be described hereinafter.

The 4-bit code signals shown in FIG. 4 are selectively generated from the note code generator 21 in accordance with musical performance at the keyboard. Assume that the note C is specified at the keyboard. When the clock pulses $\phi$ are generated by the latches 22*a* and 22*b* and the shift registers 23*a* and 23*b*, data "00" of the upper bit codes D3 and D2 are latched by the latches 22*a* and 22*b*, and data "00" of the lower bit codes D1 and D0 is stored in the shift registers 23*a* and 23*b*. The basic data l corresponding to the input data "00" is read out from the note ROM 24 and is latched by the latch 25 when the clock pulses $\phi$ are generated by the latch 25. The 3-bit basic data l is supplied to the transfer gates G1 to G16. At the same time, the data of the code D2 from the latch 22*b* is latched by the latch 29. In this case, the shift register 23*b* generates data "0" of the note code D0, so that the transfer gates G9 to G16 are opened. The basic data l is shifted by one upper bit and is supplied to the OR gates a2 to a4. Meanwhile, the non-shifted basic data l is supplied to the transfer gates G17 to G19. In this case, the outputs from the S terminals of the full-adder 27 are set to be all "0", and the values latched by the latch 28 are set to be all "0". Therefore, the output from the OR gate 35 is set to be logic "0". Data of "0" are supplied to the A0 and A1 terminals of the full-adder 27. Data of logic "0" are also supplied to the OR gates a1 to a4. As a result, the basic data l is supplied to the A3 to A5 terminals of the full-adder 27. At the same time, the outputs from the shift registers 23*a* and 23*b* are set to be both "0", so that the output from the AND gate 31 is set to be logic "0". On the other hand, since the output from the OR gate 35 is set to be logic "0", the output from the OR gate 36 is set to be logic "0". In this condition, the transfer gates G33 to G36 are closed, while the transfer gates G17 to G20 are opened. The basic data l is supplied to the B0 to B2 terminals of the full-adder 27, and data of logic "0" from the latch 28 are supplied to the B4 and B5 terminals thereof. The ground level "0" is supplied to the A2 and B3 terminals of the full adder 27 through the transfer gates G9 and G16.

The basic data l is shifted by three upper bits so that shifted data having a value eight times that of the basic data is supplied to the A terminals of the full-adder 27. The basic data l is also supplied to the B terminals of the full-adder 27 without shifting. The shifted data and the basic data l are added by the full-adder 27, so that the resultant integer multiple data (nine times the basic data, that is, $8l+l=9l$) appears at the S terminals of the full-adder 27. Therefore, data which has a value only 1/9 the resultant integer multiple data for the note C can be stored in the note ROM 24 as the basic data so as to obtain the desired integer multiple data at the S terminals.

In this case, the outputs from the latch 29 and the shift registers 23*a* and 23*b* are set to be all "0", and the output from the AND gates 30 and 31 are set to be both "0". Since the outputs from the AND gates 30 and 31 are supplied to the OR gate 32, the output from the OR gate 32 is set to be logic "0". On the other hand, as described above, the output from the OR gate 35 is set to be logic "0". The outputs from the OR gates 32 and 35 are both supplied to the AND gate 33, so that the output from the AND gate 33 is set to be logic "0". The transfer gates G21 to G26 are opened, so that the integer multiple data from the S terminals of the full-adder 27 is latched by the latch 28.

This integer multiple data is latched by the latch 28 when the clock pulses $\phi$ are generated from the latch 28. One bit of the integer multiple data is always set to be logic "1", so that the output from the OR gate 35 is set to be logic "1". As a result, data of logic "1" are supplied to all the A0 to A5 terminals of the full-adder 27. The output from the OR gate 36 is set to be logic "1" irrespective of the output value of the AND gate 31. The transfer gates G17 to G20 are closed, so the basic data l is not supplied from the latch 25 to the B terminals of the full-adder 27. Instead, the transfer gates G33 to G36 are opened, and the integer multiple data from the latch 28 is supplied to the B0 to B5 terminals of the full-adder 27.

For this reason, the full-adder 27 performs the following operation: (integer multiple data)+111111, that is, (integer multiple data)−1. The calculated result appears at the S terminals of the full-adder 27. This result is latched by the latch 28 when the latch 28 generates the clock pulses $\phi$. Every time the clock pulses are generated, the integer multiple data is decremented by one. This calculation is repeated $(l+1)$ times. When the integer multiple data becomes zero, the output from the OR gate 35 is set to be logic "0", and the waveform data read clock is one-shot generated through an inverter 38. When the output from the OR gate 35 becomes logic "0" again, another basic data l is supplied again to the A and B terminals of the full adder 27. The same operation as described above is then repeated.

The waveform data read clock is supplied to the waveform memory, so that the sampled peak value data is read out from the waveform memory. After eight read clocks are generated, the peak value data corresponding to the one-period waveform can be read out. Subsequently, when another one-period waveform data is read out from the waveform memory, the tone corresponding to the note C is generated. For this reason, when the integer multiple data latched by the latch 28 is larger, the time interval between the adjacent waveform data read clocks is increased, and the tone frequency to be produced is decreased. As a result, a lower sound is generated.

Assume that the note G which has an interval of a perfect fifth with the note C and has a period two-thirds that of the note C is performed. The upper bit codes D3 and D2 of the note code signal of the note G are given to be "00" in the same manner as in the note C. However, the lower bit codes D1 and D0 are given by data "11". The basic data read out from the note ROM 24 and latched by the latch 25 are the same as those for the note C. However, the output from the shift register 23*b* is set to be logic "1", so that the transfer gates G1 to G8 are opened. In addition, the transfer gates G17 to G20 are opened in the same manner as for the note C. The basic data l is supplied to the A2 to A4 terminals and the B1 to B3 terminals of the full-adder 27. In this manner, data 4l obtained by shifting the basic data l by two upper bits is supplied to the A terminals of the full-adder 27, and data 2l obtained by shifting the basic data l by one upper bit is supplied to the B terminals thereof. The full-adder adds the data 4l and the data 2l, and generates integer multiple data 6l(=4l+2l) at the S terminals thereof. The subsequent operation is the same as that for the note C, so that a tone having a frequency 3/2 times that of the note C is generated.

Now assume that the note D which has an interval of a perfect fifth with the note G is performed. The upper bit codes D3 and D2 are given to be "00" in the same manner as for the note G. The basic data λ read out from the note ROM 24 is the same as for the notes C and G. However, the lower bit codes D1 and D0 are set to be "01", so that the transfer gates G1 to G8 are opened and the basic data l is supplied to the A2 to A5 terminals of the full-adder 27. The output from the AND gate 31 is set to be logic "1", and the transfer gates G17 to G20 are closed, while the transfer gates G33 to G36 are opened. The data of logic "0" are supplied to the B0 to B5 terminals. As a result, integer multiple data (4l+0=4l) which is four times the basic data appears at the S terminals of the full-adder 27. Since the output from the AND gate 31 is set to be logic "1" and the output from the OR gate 35 is initially set to be logic "0", an output from the AND gate 33 is set to be logic "1" through the OR gate 32. The transfer gates G27 to G32 are then opened, and the integer multiple data at the S terminals of the full-adder 27 is shifted by one upper bit. The integer multiple data is thus further doubled, and the shifted data is latched by the latch 28. By this doubling, the notes G and D have higher frequencies with reference to the note C. Even when the interval of the perfect fifth exceeds one octave with respect to the note D, the note D of the lower octave can be obtained. After doubling the integer multiple data as described above, the subsequent operation can be performed in the same manner as for the notes C and G. However, since the output from the OR gate 35 is set to be logic "1", the AND gate 33 is opened, and the transfer gates G21 to G26 are opened. For this reason, the output from the full-adder 27 will not be undesirably shifted at the subtraction operation, thereby properly producing the note D.

The values of the upper bit codes D3 and D2 of the basic data l change for the sets of A, E and B, D#, A# and F, and F#, C# and G#. However, the same operation can be repeated. Further, in the case of the notes E and C#, the interval of the perfect fifth exceeds one octave, so that the transfer gates G27 to G32 must be opened. This can be performed such that the output from the AND gate 30 is set to be "1" only for the perfect fifth between the notes E and C#, and the output from the AND gate is set to be logic "1".

In the three notes such as C, G and D which comprise a sequence of perfect fifths, the data read out from the note ROM 24 can be commonly used. This data is multiplied by the integers nine, six and four. Therefore, only one common basic data l need be stored in the note ROM for each set of three notes. This is true for any other set such as A, E and B, and D#, A# and F. Therefore, only four basic data need be prepared to generate 12 notes of one octave. The values of the basic data l stored in the note ROM 24 can be 1/9 of the values of the integer multiple data to be actually used. For example, if the data to be actually used comprises 6-bit data, the common data stored in the note ROM can comprise 3-bit data. Therefore, the memory capacity of the note ROM 24 can be greatly decreased as compared with that of the first embodiment.

The basic data stored in the note ROM 24 are prepared for one octave. However, in order to generate notes of other octaves, the waveform data read clock can be frequency-divided into halves and quarters.

In the first and second embodiments, common basic data are stored for the notes which have an interval of a perfect fifth and whose tone frequency ratio is given to be 2:3. However, common basic data may be stored for notes which have an interval of a perfect fourth and whose tone frequency ratio is given to be 3:4.

In addition, in the second embodiment, common basic data are stored for every three notes (e.g., C, G and D) and is multiplied by the integers nine, six and four. However, common basic data for every four notes such as C, G, D and A which comprise a sequence of perfect fifths can be stored, and then multiplied by the integer 27, 18, 12 and 8. In addition, even smaller basic data can be stored in correspondence with a larger number of notes, and can be multiplied by larger integers.

In addition to this modification, data for a plurality of octaves may be stored in the note ROM, unlike in the first and second embodiments.

In the first and second embodiments, only small-value data for preparing various note code signals in a simple integer ratio of tone frequencies are stored. Each small-value data is read out and is multiplied by a predetermined integer to obtain desired integer multiple data. In this manner, single common data can be stored for a plurality of note code signals. In addition, since the basic data have small values, the note ROM can have a small capacity, resulting in convenience.

A third embodiment will be described with reference to FIGS. 5 and 6 wherein the note ROM is omitted. According to this embodiment, in the case of three notes (e.g., C, G and D wherein the note D belongs to a given octave which is higher by one than the octave including the notes C and G, and A, E and B wherein the notes E and B belong to a given octave which is higher by one than the octave including the note A) whose tone frequency ratio is given to be 4:6:9, upper bit codes D3 and D2 of the respective note code signals are given as shown in FIG. 6. The values of the codes D3 and D2 are multiplied by the integers nine, six and four in accordance with the ratio of 4:6:9 on the basis of the values of the lower bit codes D1 and D0 thereof. A ratio of periods of the notes A, F#, D# to C among the sets of the notes C, G and D, A, E and B, D#, A# and F, and F#, C# and G# is given to be substantially 4:5:6:7. In order to achieve this ratio, the upper codes D3 and D2 are set to be "00", "01", "10" and "11" ("0" is binary low level, and "1" is binary high level) so that they become 4, 5, 6 and 7 after addition of 1 at positions next to the MSBs. In addition, the ratio is not an accurate ratio of 4:5:6:7, but is actually a ratio of 4.05:4.86:5.83:7. Correction can be performed by the values of the codes D1 and D2.

Figure 5:
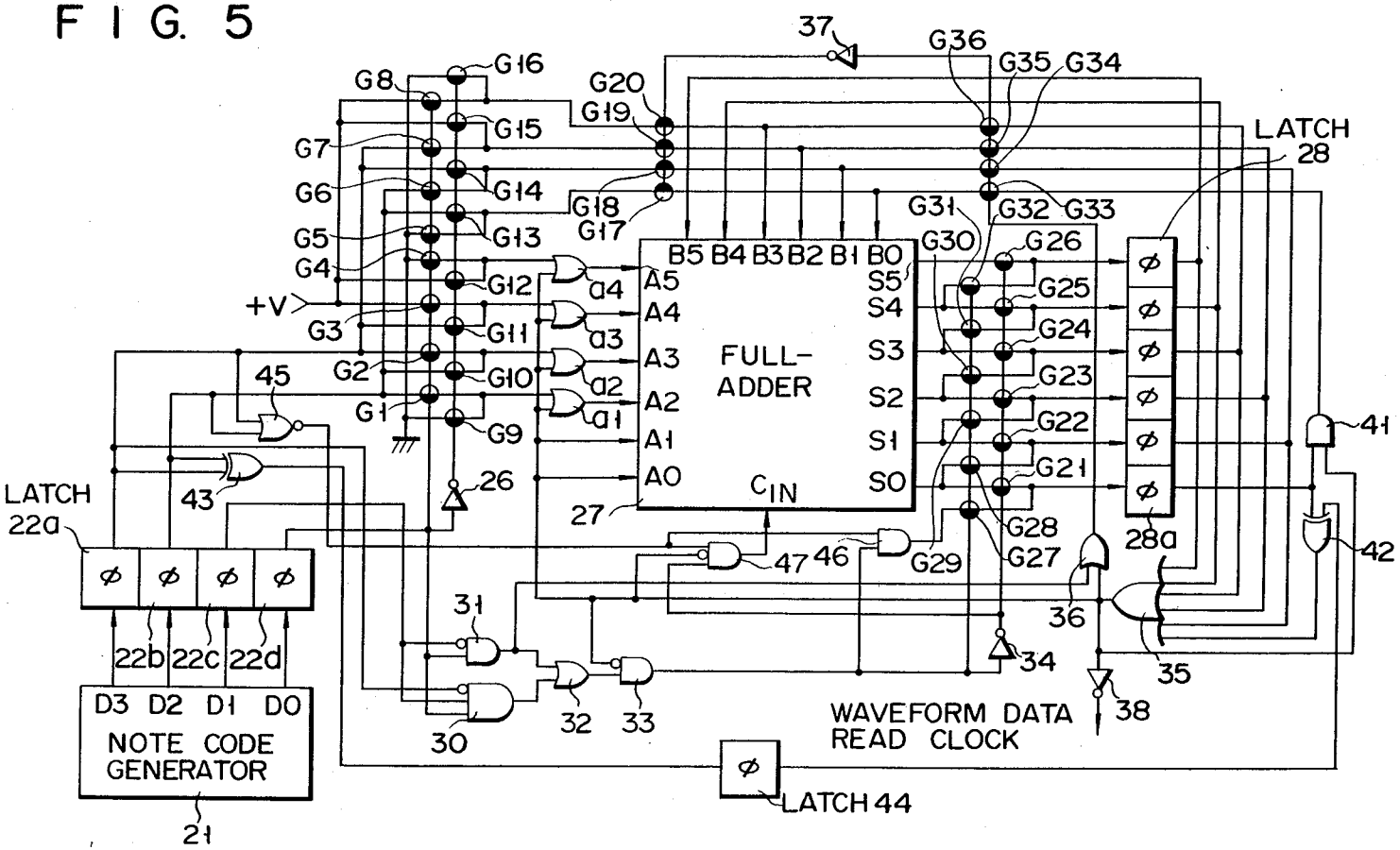
FIG. 5 is a block diagram of a waveform data read signal generating apparatus according to still another embodiment of the present invention.

The same reference numerals used in FIG. 5 denote the same parts as in FIG. 3, and a detailed description thereof will be omitted. A note code generator 21 generates 4-bit note code signals (FIG. 6) each consisting of note codes D3 to D0. The bit data of each note code signal are respectively latched by latches 22*a*, 22*b*, 22*c* and 22*d* when these latches generate the clock pulses $\phi$. The upper bit codes D3 and D2 of the binary codes D3 to D0 are used as basic data which is subjected to incrementation by 1 and integer multiplication. On the other hand, the lower bit codes D1 and D0 are used for multiplication by the integers nine, six and four, and for correcting the integer multiple data.

The data of the code D0 latched by the latch 22*d* is supplied to transfer gates G1 to G8 which are then controlled. The data of the code D0 is also supplied to transfer gates G9 to G16 through an inverter 26, so that the on/off operation of the transfer gates G9 to G16 is controlled. One of the sets of transfer gates G1 to G8 and G9 to G16 is opened. The ground level "0" is applied to the transfer gate G9 of the set of transfer gates G9 to G12, and to the transfer gate G5 of the set of transfer gates G5 to G8. The signal +V of level "1" is applied to the transfer gates G12 and G8. The outputs of the binary codes D3 and D2 are supplied from the latches 22*a* and 22*b* to the transfer gates G11 and G10, and the transfer gates G7 and G6. The ground level "0" is applied to the transfer gate G16 of the set of transfer gates G13 to G16, and to the transfer gate G4 of the set of transfer gates G1 to G4. The signal +V of level "1" is applied to the transfer gates G5 and G3. The outputs of the binary codes D3 and D2 are supplied from the latches 22*a* and 22*b* to the transfer gates G14 and G13 and the transfer gates G2 and G1.

Among these transfer gates, the outputs from the transfer gates G9 to G12 and the transfer gates G1 to G4 are supplied to the A2 to A5 terminals of a full-adder 27 through OR gates a1 to a4, respectively. The outputs from the transfer gates G13 to G16 and G5 to G8 are supplied to the B0 to B3 terminals of the full-adder 27 through other transfer gates G17 to G20, respectively.

An inverted output of the output from the latch 22*c* and an output from the latch 22*d* are supplied to an AND gate 31. On the other hand, an inverted output of the output from the latch 22*a* and the outputs from the latches 22*c* and 22*d* are supplied to an AND gate 30.

The four lower bit data of the integer multiple data are latched by a latch 28 and are supplied to the B0 to B3 terminals of the full-adder 27 through transfer gates G33 to G36, respectively, with only the LSB data from the latch 28*a* being gated through an AND gate 41. On the other hand, the two upper bit data of the integer multiple data are supplied directly to the B4 and B5 terminals of the full-adder 27. The latched integer multiple data is also supplied to the A0 and A1 terminals of the full-adder 27 through an OR gate 35, with only the LSB data from the latch 28*a* being gated through an exclusive OR gate 42, and to the A2 to A5 terminals through the OR gates a1 to a4. The output from the OR gate 35 is also supplied to an OR gate 36 and the AND gate 41.

The exclusive OR gate 42 receives through a latch 44 an output from an exclusive OR gate 43 which receives the outputs from the latches 22*a* and 22*b*. In the case of the note D#, A#, F, F#, C# or G# whose upper bit codes D3 and D2 are set to be "01" or "10", when outputs from the latches 28 excluding the latch 28*a* are set to be all "0", and the output from the latch 28*a* is set to be logic "1", an output from the OR gate 35 is set to be logic "0".

The outputs from the latches 22*a* and 22*b* are supplied to a NOR gate 45. An output from the NOR gate 45 and an output from the AND gate 33 are supplied to an AND gate 46. An output from the AND gate 46 is supplied to the transfer gate G27. In the case of the note E or B whose codes D3 and D2 are set to be "00" and codes D3, D1 and D0 are set to be "0 11" (E) or codes D1 and D0 are set to be "01" (B), the transfer gates G27 to G32 are opened. When the integer multiple data is shifted by one upper bit and is latched by the latches 28, logic "1" is latched by the latch 28*a*. The output from the NOR gate 45, an inverted output of the output from the OR gate 35 and the output from the inverter 34 are supplied to an AND gate 47. An output from the AND gate 47 is supplied to a CIN (carry-in) terminal of the full-adder 27. In the case of the note A whose codes D3 and D2 are set to be "00" so as to open the AND gate 33, a signal of logic "1" is supplied to the CIN terminal of the full adder 27, so that the integer multiple data appearing at the S terminals is incremented by one.

The operation of the third embodiment will now be described.

The frequency ratio of the three notes constituting a sequence of perfect fifths is given to be 9:6:4. The accurate period ratio of the note code groups is given to be 7:5.83:4.86:4.05. When the data value of the lowest note C having the longest period is given to be $63=(9\times7)$, other notes have the values shown in FIG. 7. In order to derive these values, the period ratio of the note code groups is given to be 7:6:5:4, which is respectively multiplied by 9, 6, and 4. The values of those notes D, F, C#, G#, E and B which exceed the one-octave range are doubled, respectively. The values of the notes D#, A#, F, F#, C# and G# are decremented by one, respectively. The notes A, E and B are incremented by one.

Four-bit note code signals which vary in accordance with the notes shown in FIG. 6 are generated from the note code generator 21 in accordance with musical performance at the keyboard. When the note C is played at the keyboard, for example, the codes D3, D2, D1 and D0 are latched as data "1100" by the latches 22*a*, 22*b*, 22*c* and 22*d* when the latches 22*a* to 22*d* generate clock signals, respectively. The logic "0" of the code D0 is generated from the latch 22*d*, so that the transfer gates G9 to G16 are opened, and the basic data "111" obtained by adding "1" to the upper position next to the MSB of data of the codes D3 and D2 of "11" is supplied to the OR gates a2 to a4 and the transfer gates G17 to G19. The ground level "0" is supplied to the OR gate a1 and the transfer gate G20.

At the same time, since the outputs appearing at the S terminals of the full-adder 27 are set to be all "0" and the values latched by the latches 28 are also set to be all "0", an output from the OR gate 35 is set to be logic "0".

Data of logic "0" are supplied to the A0 and A1 terminals of the full-adder 27. Data of logic "0" are supplied to the OR gates a1 to a4, so that the basic data "111" is supplied to the A3 to A5 terminals of the full-adder 27. The ground level "0" is supplied to the A2 terminal of the full-adder 27. At the same time, since the outputs from the latches 22*c* and 22*d* are set to be both "0", an output from the AND gate 31 is set to be logic "0". Furthermore, the output from the OR gate 35 is set to be logic "0", so that the output from the OR gate 36 is set to be logic "0". As a result, the transfer gates G33 to G36 are closed, while the transfer gates G17 to G20 are opened. Therefore, the basic data "111" is supplied to the B0 to B2 terminals of the full-adder 27, and the ground level "0" is supplied to the B3 terminal thereof. The data of "0" from the latches 28 are supplied to the B4 and B5 terminals of the full-adder 27 without modification.

The A terminals of the full-adder 27 receive integer multiple data "111000" (decimal 56) obtained by shifting the basic data "111" (decimal 7) so as to multiply the basic data by eight. The B terminals of the full-adder 27 receive the basic data "000111" (decimal 7), so that the full-adder 27 adds the integer multiple data and the basic data to obtain resultant integer multiple data "111111" (decimal 63), which has a value nine times that of the basic data. The data "111111" appears at the S terminals of the full-adder 27. Therefore, the integer multiple data is prepared using the codes D3 and D2.

In this case, the AND gate 30 receives the outputs from the latches 22*a*, 22*c* and 22*d* and generates an output of logic "0". The output from the AND gate 31 is set to be logic "0". The outputs from the AND gates 30 and 31 are supplied to the OR gate 32, so that an output from the OR gate 32 is set to be logic "0". In addition, the output from the OR gate 35 is set to be logic "0". The outputs from the OR gates 32 and 35 are supplied to the AND gate 33, so that the output from the AND gate 33 is set to be logic "0". The transfer gates G21 to G26 are opened, and the integer multiple data from the S terminals of the full-adder 27 is supplied to the latches 28.

The integer multiple data "111111" is latched by the latches 28 when the clock pulses are generated therefrom. When an output from the OR gate 35 is set to be logic "1", the A0 to A5 terminals of the full-adder 27 are set to be all "1". The output from the OR gate 36 is set to be logic "1" irrespective of the logic level of the signal from the AND gate 31. The transfer gates G17 to G20 are closed, and the basic data "111" from the latches 22*a* and 22*b* is not supplied to the B terminals of the full-adder 27. Instead, the transfer gates G33 to G36 are opened. The output from the OR gate 35 is set to be logic "1", so that the AND gate 41 is opened. The integer multiple data "111111" is gated from the latches 28 to the B0 to B5 terminals of the full-adder 27.

The full-adder 27 then performs the following calculation: (integer multiple data "111111")+111111, that is, "111111"−1, and the resultant data appears at the S terminals of the full-adder 27. The next integer multiple data "111110" is latched by the latches 28 when the next clock pulses are generated therefrom. Every time the clock pulses $\phi$ are generated, another integer multiple data is obtained such that the immediately preceding integer multiple data is decremented by one. This subtraction operation is repeated 63 times until the output from the OR gate 35 becomes logic "0". The waveform data read clock of logic "1" is one-shot generated through the inverter 38. When the output from the OR gate 35 is set to be logic "0", the basic data "111" is supplied again to the A and B terminals of the full-adder 27, and the same operation as described above is repeated.

Assume that the note G is played. The note G has an interval of a perfect fifth from the note C, and has a period $\frac{2}{3}$ that of the note C. A note code signal "1111" is generated for the note G wherein the codes D3 and D2 of the note G are the same as those of the note C and the codes D1 and D0 thereof are different from those of the note C. The basic data "111" (decimal 7) is the same as that for the note C. However, the output from the latch 22*d* is set to be logic "1", so that the transfer gates G1 to G8 are opened. In addition, in the same manner as for the note C, the transfer gates G17 to G20 are opened. As a result, the basic data "111" (decimal 7) is supplied to the A2 to A4 and B1 to B3 terminals of the full-adder 27, so that the calculation "011100"+"001110" is performed. Integer multiple data "101010" (decimal 42) which is equal to six times the basic data "111" (decimal 7) is latched by the latches 28. The subsequent operation is the same as that for the note C. As a result, a tone having a frequency 3/2 times that of the note C is generated.

Assume that the note D is played. The note D has an interval of a perfect fifth from the note G. The upper bit codes D3 and D2 of the note D are the same as those ("11") of the note G. The basic data "111" (decimal 7) of the note D is the same as that of the note G. However, the lower bit codes D1 and D0 of the note D are set to be "01" unlike those of the note G. The transfer gates G1 to G8 are opened, and the basic data "111" is supplied to the A2 to A5 terminals of the full-adder 27. In addition, the output from the AND gate 31 is set to be logic "1", and the transfer gates G17 to G20 are closed while the transfer gates G33 to G36 are opened. Therefore, the basic data "111" is supplied to the B0 to B3 terminals, and the calculation "011100"+"000000" is performed. Integer multiple data "011100" (decimal 28) which is equal to four times the basic data "111" (decimal 7) appears at the S terminals of the full-adder 27. Since the codes D1 and D0 constitute data "01", the output from the AND gate 31 is set to be logic "1" and hence the output from the OR gate 35 is set to be logic "1". On the other hand, the output from the OR gate 32 is initially set to be logic "0", so that the output from the AND gate 33 for receiving the output from the OR gate 32 and an inverted output of the output from the OR gate 35 is set to be logic "1". For this reason, the transfer gates G27 to G32 are opened, and the integer multiple data "011100" (decimal 28) appearing at the S terminals of the full-adder 27 is shifted by one upper bit, so that data "111000" (decimal 56) which is equal to twice the basic data is latched by the latches 28. By this multiplication, the notes G and D have higher pitches with respect to the note C in the order named. Even if the note D exceeds the one-octave range, the note D belonging to the immediately lower octave can be obtained. Thereafter, the note D can be generated in the same manner as the notes C and G. However, the output from the OR gate 35 is set to be logic "1" and the AND gate 33 is closed. The transfer gates G21 to G26 are opened. Therefore, the output from the full-adder 27 will not be shifted, and a proper tone corresponding to the note D can be generated.

In the case of the sets of notes A, E and B, D#, A# and F, and F#, C# and G, the same operation as described above is performed except that the upper codes D3 and D2 thereof are set to be "00", "10" and "01", respectively, and the basic data are set to be "100" (decimal 4), "110" (decimal 6) and "101" (decimal 5), respectively. However, in the case of the notes E and C#, unlike the case of the note G, the note C# belongs to an octave one higher than the octave to which the note E belongs. In this case, the transfer gates G27 to G32 must be opened. This can be accomplished such that the output from the AND gate 30 is set to be logic "1" only for the notes E and C#, and that the output from the AND gate 33 is set to be logic "1". The basic data m is prepared by using the note codes D3 and D2 so as to derive integer multiple data, thereby reading out the waveform data.

However, in the case of the sets of notes D#, A# and F, and F#, C# and G#, the respective basic data "110" (decimal 6) and "101" (decimal 5) are multiplied by the integers nine, six and four. When the relationship is between notes belonging to two adjacent octaves, the obtained multiple data are further doubled to prepare integer multiple data "110110" (decimal 54), "100100" (decimal 36) and "110000" (decimal 48), and "101101" (decimal 45), "111100" (decimal 60) and "101000" (decimal 40). However, each resultant data is greater by one than the required data, as shown in FIG. 7, and must be decremented by one. When the six notes described above are specified, the output from the exclusive OR gate 43 is set to be logic "1", and the decremented integer multiple data are sequentially latched by the latches 28. When the last integer multiple data "000001" is latched by the latches 28 such that the output from the LSB latch 28*a* is set to be logic "1", the output from the exclusive OR gate 42 is set to be logic "0", and the output from the OR gate 35 is set to be logic "0" at a timing which advances by one clock pulse $\phi$. Therefore, the waveform read clock of logic "1" is generated at this timing. In this manner, correction for decrementation by one is performed in practice.

On the other hand, in the case of the set of notes A, E and B, the basic data "100" (decimal 4) is multiplied by the integers nine, six and four. In the case of the relationship between the notes E and B belonging to the two adjacent octaves, the multiplied data are further doubled to obtain "100100" (decimal 36), "110000" (decimal 48) and "100000" (decimal 32). However, each of these resultant data is smaller than the corresponding necessary data by one, as shown in FIG. 7, and must be incremented by one. When the note A is played, the AND gate 47 is opened, and the signal of level "1" is supplied from the CIN terminal of the full-adder 27, so that +1 correction can be performed in practice. When the notes E and B are played, the signal of level "1" is supplied from the AND gate 46, so that the data is shifted by one upper bit and the LSB of the integer multiple data latched by the latches 28 is set to be logic "1". In this case, +1 correction is also performed in practice. Therefore, a proper sound can be generated.

In the case of a set of tones (e.g., C and F) having an interval of a perfect fourth and a frequency ratio of 3:4, one note code group is constituted to prepare a similar basic data m. In this case, the note code groups consist of C, F and A#, D#, G# and C#, F#, B and D, and A, D and G. The frequency ratio of the note groups is set to be 4:5:6:7 in the same manner as described above. Alternatively, there can be three code groups C, F, A# and D#, G#, C#, F# and B, and E, A, D and G. In this case, the frequency ratio of the note groups is set to be 4:5:6.

According to this embodiment, a plurality of note code groups in units of a plurality of note codes given by a simple integer ratio, are prepared. The respective basic data are preset for the respective code groups in accordance with the frequency ratio of the code groups, and are used as part of the note codes. Therefore, part of the note code signal is multiplied by integers in accordance with the data of the note code signal, to obtain data having a frequency of a tone to be generated. Thus, a note ROM for storing pitch data corresponding to the tone to be generated need not be used. As a result, the number of circuit elements constituting the waveform data read device can be reduced, thereby providing a low-cost waveform data read clock generating apparatus.

What is claimed is:

1. A waveform data read signal generating apparatus, comprising:

note code signal generating means for generating a plurality of note code signals in accordance with a musical performance, said note code signals representing respective notes, the frequencies of the notes designated by at least two of said note code signals being set at an integer ratio, said note code signals each including a common bit signal comprised of a plurality of bits and also including other different bit signals;

basic data generating means for generating basic data according to the common bit signals of said note code signals supplied from said note code signal generating means;

multiplying means coupled to said note code signal generating means and to said basic data generating means for multiplying the basic data by an integer, as determined by the other bit signals of said note code signals, to provide an integer multiple data; and calculating means for generating a waveform data read signal in accordance with the integer multiple data provided by the multiplying means, said waveform data read signal having a frequency corresponding to the note code signals.

2. An apparatus according to claim 1, wherein said basic data generating means includes memory means arranged to be addressed by the common bit signal, and which generates the basic data which is common to at least two notes corresponding to said at least two note code signals.

3. An apparatus according to claim 2, wherein said basic data multiplying means includes: discriminating means for receiving at least one bit of each of said code signals of said at least two notes to discriminate at least two performed notes; first gate means for receiving the basic data read out from said memory means; second gate means, controlled in response to an output from said discriminating means, for receiving the basic data read out from said memory means; a full-adder having first and second input terminals which respectively receive outputs from said first and second gate means and an output terminal which generates said integer multiple data; and means for shifting an output data of said first gate means by a number of bits according to the integer ratio and for supplying the shifted output of said first gate means to said first input terminal of said full-adder.

4. An apparatus according to claim 3, wherein said calculating means comprises: decrementing means having gate controlling means for supplying all "1" data to said first input terminal of said full-adder in response to the integer multiple data appearing at said output terminal of said full-adder and for closing said second gate means, and means for supplying the integer multiple data to said second input terminal of said full-adder; and means for detecting all "0" data appearing at said output terminal of said full-adder and thereupon generating a one-shot waveform data read clock signal.

5. An apparatus according to claim 2, wherein said at least two notes have a frequency ratio of 2:3 and an interval of a perfect fifth therebetween.

6. An apparatus according to claim 5, wherein said basic data multiplying means is operated such that the basic data is multiplied by three when a code signal of a lower note of said at least two notes having the interval of the perfect fifth therebetween is generated, and that the basic data is doubled when a code signal of a higher note thereof is generated.

7. An apparatus according to claim 2, wherein said basic data multiplying means includes: discriminating means for receiving at least two bits of each of at least three note code signals and discriminating at least three performed notes; first gate means having first and second gate groups for receiving the basic data read out from said memory means and performing gating in response to an output from said discriminating means; second gate means including third and fourth gate groups for performing gating in response to the output from said discriminating means; a full-adder having first and second input terminals which respectively receive outputs from said first and second gate means and an output terminal for generating integer multiple data; and means for shifting the integer multiple data by a number of bits according to an integer ratio and for supplying outputs from the said first and second gate means to said first and second input terminals of said full-adder.

8. An apparatus according to claim 7, wherein said calculating means comprises: integer multiple data decrementing means having third gate means which includes fifth and sixth gate groups for performing gating in response to the output from said discriminating means, gate controlling means for supplying all "1" data to said first input terminal of said full-adder in accordance with the integer multiple data received through said third gate means and for inhibiting signal supply from said second gate means to said second input terminal, and means for supplying the integer multiple data to said second input terminal of said full-adder; and means for detecting all "0" data at said output terminal of said full-adder and generating a one-shot waveform data read clock signal.

9. An apparatus according to claim 7, wherein said at least three notes have a frequency ratio of 4:6:9 and constitute a sequence of a perfect fifth thereamong.

10. An apparatus according to claim 9, wherein the basic data is multiplied by nine when a code signal of a lowest note among said at least three notes having the interval of the perfect fifth thereamong is generated, the basic data is multiplied by six when a code signal of an intermediate note thereamong is generated, and the basic data is multiplied by four when a code signal of a highest note thereamong is generated.

11. An apparatus according to claim 10, further including means for doubling the integer multiple data of a currently performed note when the currently performed note belongs to a higher octave by one than another octave to which an immediately preceding played note having an interval of a perfect fifth with the currently performed note belongs.

12. An apparatus according to claim 2, wherein said at least two notes have a frequency ratio of 3:4 and an interval of a perfect fourth.

13. An apparatus according to claim 12, wherein said basic data multiplying means multiplies the basic data by four when a code signal of a lower note of said at least two notes having the interval of a perfect fourth therebetween is generated, and by three when a code signal of a higher note thereof is generated.

14. An apparatus according to claim 7, wherein said at least three notes have a frequency ratio of 9:12:16 and constitute a sequence of a perfect fourth thereamong.

15. An apparatus according to claim 14, wherein said basic data multiplying means multiplies the basic data by 16 when a code signal of a lowest note among said at least three notes constituting the sequence of a perfect fourth is generated, by 12 when a code signal of an intermediate note thereamong is generated, and by nine when a code signal of a highest note thereamong is generated.

16. An apparatus according to claim 15, further including means for doubling the integer multiple data of a currently performed note when the currently performed note belongs to a higher octave by one than another octave to which an immediately preceding performed note having an interval of a perfect fifth with the currently performed note belongs.

17. An apparatus according to claim 1, wherein:

said note code signals generating means is arranged to generate a plurality of the note code signals which are divided into a plurality of note code groups, said note code signals including the common bit signals which vary for said note code groups, and said basic data generating means includes means for using, as at least part of the basic data, the plurality of common bit signals in the note code signals.

18. An apparatus according to claim 17, wherein said basic data generating means includes means for generating the basic data by adding at least one bit to the plurality of common bit signals.

19. An apparatus according to claim 18, wherein said basic data multiplying means includes discriminating means for receiving at least two bits of each of the note code signals of the note code groups and discriminating at least three performed notes; first gate means for receiving the basic data and having first and second gate groups for performing gating in response to an output from said discriminating means; second gate means including third and fourth gate groups for performing gating in response to the output from said discriminating means; a full-adder having first and second input terminals which respectively receive outputs from said first and second gate means and an output terminal for generating integer multiple data; and means for shifting output data of said first and second gate means by a number of bits according to the integer ratio and for supplying the shifted output data of said first and second gate means to said first and second input terminals of said full-adder, respectively.

20. An apparatus according to claim 19, wherein said at least three notes have a frequency ratio of 4:6:9 and constitute a sequence of a perfect fifth; and the note code groups comprise four groups each of which has three notes, four corresponding notes of the respective note code groups having a frequency ratio of about 4:5:6:7.

21. An apparatus according to claim 20, wherein the plurality of common bit signals are "00", "01", "10" and "11", and data of logic "1" is added to a position next to the most significant bit of the plurality of common bit signals to constitute 3-bit basic data "100", "101", "110", and "111".

22. An apparatus according to claim 21, wherein said basic data multiplying means have a function of multiplying the 3-bit basic data by nine, six and four, respectively.

23. An apparatus according to claim 19, wherein said at least three notes have a frequency ratio of 9:12:16 and constitute a sequence of a perfect fourth, and the note code groups comprise four groups each of which has three notes, four corresponding notes of the respective note code groups having a frequency ratio of about 4:5:6:7.

24. An apparatus according to claim 23, wherein the plurality of common bit signals are "00", "01", "10" and "11", and data of logic "1" is added to a position next to the most significant bit of the plurality of common bit signals to constitute 3-bit basic data "100", "101", "110", and "111".

25. An apparatus according to claim 24, wherein said basic data multiplying means is arranged to perform multiplication of the 3-bit basic data by 16, 12 and 9.

26. An apparatus according to claim 19, wherein said notes comprise four notes which have a frequency ratio of about 9:12:16:21 and which constitute a sequence of a perfect fourth; the note code groups comprise three groups each of which has four notes, three corresponding notes of the respective note code groups having a frequency ratio of about 4:5:6.

* * * * *